US005530982A

United States Patent [19]

Specht

[11] Patent Number: 5,530,982

[45] **Date of Patent: *Jul. 2, 1996**

[54] WRINGABLE FLAT-SURFACE SPONGE MOP

[75] Inventor: Paul B. Specht, Wilmette, Ill.

[73] Assignee: M. B. Walton, Inc., Del.

[ * ] Notice: The term of this patent shall not extend beyond the expiration date of Pat. No. 5,438,727.

[21] Appl. No.: 453,653

[22] Filed: May 30, 1995

Related U.S. Application Data

[63] Continuation of Ser. No. 179,095, Jan. 10, 1994, Pat. No. 5,438,727.

[51] Int. Cl.[6] ..... A47L 13/26

[52] U.S. Cl. ..... 15/119.2; 15/244.1

[58] Field of Search ..... 15/116.1, 116.2, 15/119.1, 119.2, 244.1, 244.4

[56] References Cited

U.S. PATENT DOCUMENTS

| | | | |
|---|---|---|---|
| 2,194,150 | 3/1940 | Price | 15/119.2 |
| 2,221,557 | 12/1940 | Rogers | 15/119 |
| 2,224,462 | 12/1940 | Williams | 15/119 |
| 2,239,759 | 4/1941 | Schulenburg | 15/119 |
| 2,251,384 | 8/1941 | Thomas | 15/119 |
| 2,729,840 | 1/1956 | Rogers | 15/119 |
| 2,735,126 | 2/1956 | Proffitt | 15/147 |
| 2,740,146 | 4/1956 | Vaughn | 15/119.2 |
| 2,794,198 | 6/1957 | Rogers | 15/119 |
| 3,226,752 | 1/1966 | Antonucci, Jr. | 15/119 |
| 4,137,592 | 2/1979 | Brown, Jr. | 15/119 |
| 4,438,540 | 3/1984 | Senour | 15/119 |
| 4,516,287 | 5/1985 | Johnson et al. | 15/119 |
| 5,080,517 | 1/1992 | Lynn | 15/119 |

FOREIGN PATENT DOCUMENTS

| | | | |
|---|---|---|---|
| 1225875 | 7/1960 | France | 15/116.2 |
| 618522 | 3/1961 | Italy | 15/116.2 |
| 659037 | 12/1963 | Italy | 15/119.2 |
| 304665 | 4/1955 | Switzerland | 15/119.2 |
| 396469 | 8/1933 | United Kingdom | 15/119.1 |

*Primary Examiner*—David Scherbel
*Assistant Examiner*—Tony G. Soohoo
*Attorney, Agent, or Firm*—Leydig, Voit & Mayer, Ltd.

[57] ABSTRACT

This self-wringable mop comprises an elongated handle; a support assembly secured adjacent the normally-lower extremity of the handle, and having a generally-planar surface disposed at an angle to the longitudinal axis of the handle; a compressible absorbent cleaning element having a first surface substantially registering with and detachably secured to the generally-planar surface of the support assembly, and an opposed substantially-flat second surface exposed and oriented so that substantially the full area is contactable with substantially-flat surfaces to be mopped; and a manually-actionable wringing assembly comprising a lever mechanism pivotally mounted in relation to the handle, and a single roller unit operably secured to the lever mechanism and disposed so that upon manual actuation the roller unit rolls over and progressively compresses the cleaning element against the generally-planar surface of the support assembly, thereby wringing absorbed fluids from the cleaning element, the wringing assembly being disposed when in an at-rest position so as not to interfere with mopping operation.

11 Claims, 4 Drawing Sheets

FIG. 4
FIG. 7
FIG. 5
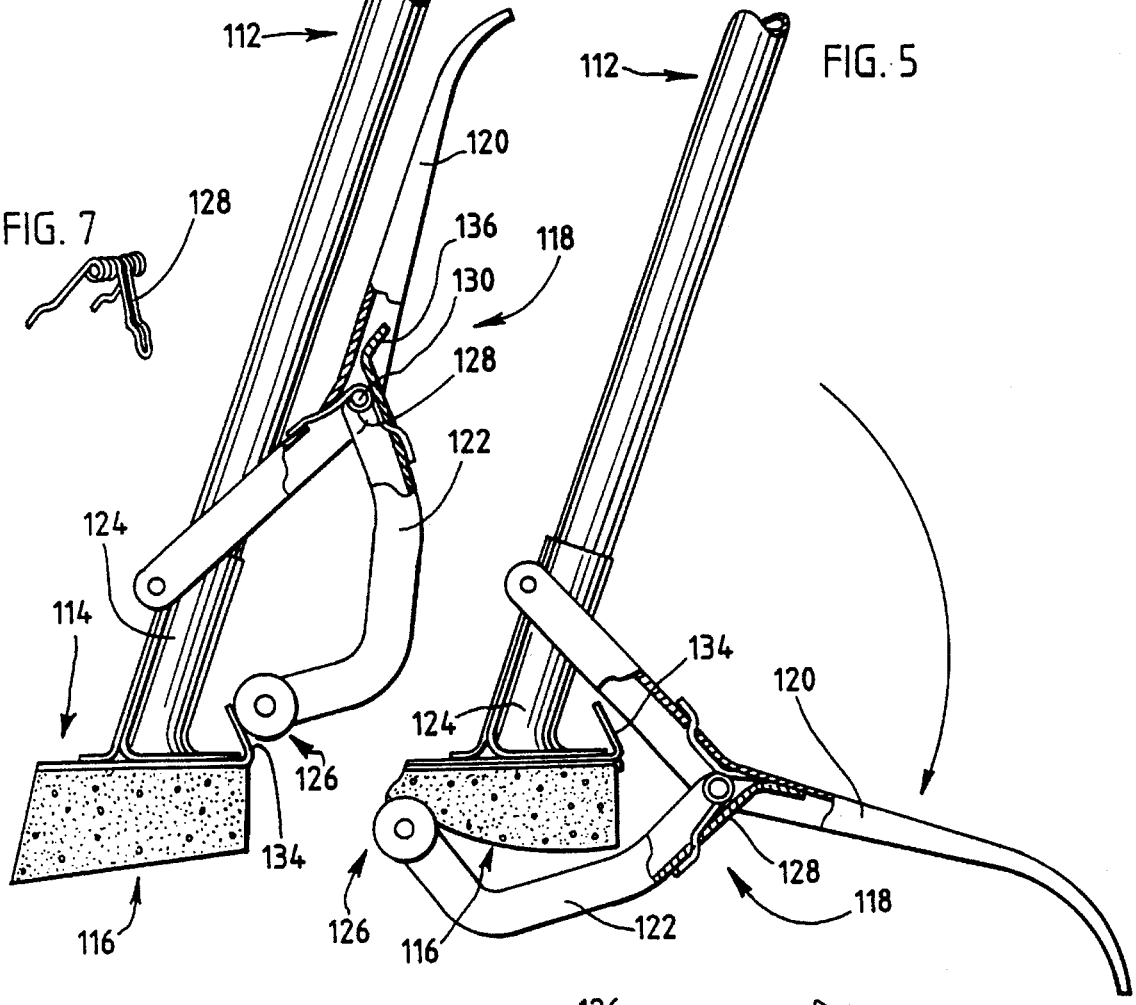
FIG. 6
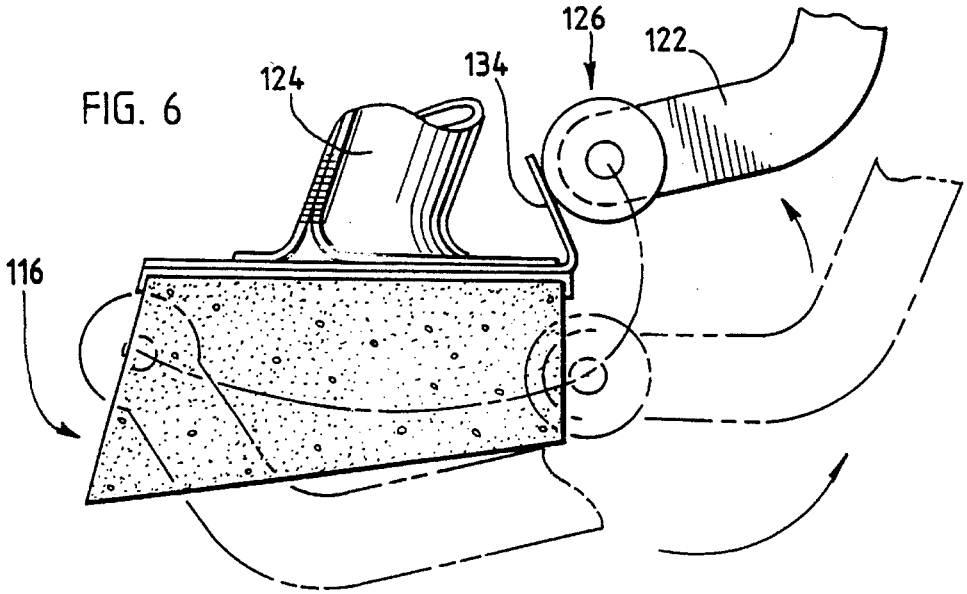

WRINGABLE FLAT-SURFACE SPONGE MOP

This application is a continuation of application Ser. No. 08/179,095, filed Jan. 10, 1994, now U.S. Pat. No. 5,438,727.

BACKGROUND OF THE INVENTION

This invention relates to household-type mops and more particularly to wet mops employing compressible absorbent cleaning elements with flat mopping surfaces and having built-in means for wringing absorbed moisture therefrom. More specifically, it relates to an advanced wringable household mop which provides improved performance and appearance, employs user-friendly components and is otherwise ergonomically correct, and can be manufactured at competitive costs.

As will be apparent, the compressible absorbent cleaning element in the preferred embodiment of the invention comprises natural or synthetic sponge materials similar to those extensively employed in various forms in prior art mops for such purposes. Each of the many prior-art wringable mops employing same, however, suffer from one or more shortcomings. For example, many of the presently-designed sponge mops have rounded or curved cross sections which undesirably minimize the mop area in actual contact with the surface being mopped, or vary such area, sometimes unevenly, depending upon the pressure applied. This cuts down on mopping uniformity and efficiency and accelerates or causes uneven wear.

Built-in mechanisms for self-wringing of the prior-art sponges are popular but have their own set of problems. For example, in some instances, particularly in the case of mops employing flat sponges, the wringing mechanisms are effective in removing absorbed moisture but have a tendency to entrap dirt particles. Instead, the wringing mechanism should preferably tend to flush out the dirt particles along with the absorbed fluids.

In some instances, the wringing mechanisms perform their function but create still other problems. For example, some wringing mechanisms flex the normally-flat sponge as much as 150° or more, potentially leading to premature stress failure. Some wringing mechanisms or portions thereof are forwardly disposed and obscure all or portions of the forward edge of the sponge from the vision of the user. They also act like an unnecessary bumper and inhibit efforts to advance the sponge itself to the immediate proximity of upstanding articles, such as walls, furniture, and the like.

Similarly, some wringing mechanisms, while not forward facing, project in the "at-rest" position beyond the sides of the sponge, again inhibiting the ability to mop surfaces immediately adjacent upstanding articles. They also create the potential for damage or appearance problems, particularly from scraping or marring contact. When stored, some wringing mechanisms unduly project from the mop itself and take up excessive space or obstruct the storage area.

Other sponge mop wringer designs employ rollers which necessarily operate at a fixed radius with respect to the axis of rotation and do not lend themselves to alternative embodiments which are not so limited. A design which lends itself to a variety of separate embodiments, e.g., a fixed radius, variable radii or limited-variable radii is preferable in order to meet differing requirements. Still other designs require excessive and awkward positioning and manipulative effort by the user to wring out the sponge, including rotation of the wringer lever through excessive operating arcs, e.g., as much as 130° or more. In some designs, the return stroke of the wringing-out cycle is essentially wasted motion; it has little wringing effect but still requires substantial effort.

In some prior-art designs, the wringing operation results in excessive exposure of the hands and arms of the user to the fluids and contaminants being expelled. While this problem can be minimized by repositioning of the hands during portions of the wringing-out cycle, such efforts are self-defeating from the standpoint of efficient work habits.

In still other prior-art designs the necessary periodic replacement of worn sponges is a burdensome task, sometimes requiring a tool or other instrument. Coupled with other shortcomings hereinabove set forth, the use of the mop on the whole is hardly user-friendly.

Not only must the mop of the present invention provide superior mopping and wringing functions, the cost of manufacture must be consistent with the highly competitive pricing conditions found in the marketplace for such a product. Accordingly, the number of components must be limited, the complexity thereof must be minimized and other costs of manufacture, including assembly, must be competitively acceptable. Many prior-art mops have failed one or more of these criteria. This is vividly illustrated, for example, by many prior-art designs which employ a plurality of roller units to wring out the cleaning element.

In addition to superior functionality and competitive manufacturing cost, the resulting product, by its appearance on the display shelf, must quickly appeal to the purchaser even upon superficial inspection. How it works must be readily apparent. Some prior-art designs, while achieving functionality or cost goals, fail to create or convey such perception to the average purchaser upon initial inspection. Often, this situation results in no further inspection and no sale.

OBJECTS OF THE INVENTION

It is therefore a general object of the present invention to provide an improved self-wringable mop having a flat-surfaced compressible absorbent cleaning element. It is another general object to cope with the deficiencies and shortcomings of prior-art mops employing compressible absorbent cleaning elements and built-in wringing units.

It is another general object to meet the sometimes-conflicting requirements of superior mop functionality, ergonomic correctness, competitive production costs and almost-instantaneous favorable perceptions by the average mop purchaser and user. It is still another general object to provide an improved wringable sponge mop capable of improved performance but having fewer components than prior art wringable sponge mops performing similar functions.

It is a specific object to provide a wringable sponge mop having a flat or planar contact area to maximize mopping action and efficiency. It is another specific object to provide a wringable sponge mop which tends to flush out rather than entrap dirt particles when wringing the same.

It is another specific object to provide a wringable sponge mop having a lever actuator requiring only a limited arc of actuation to wring out the mop, such arc being disposed, for example, so that the actuation efforts involve simply and naturally pushing the lever away from, or pulling it towards, the user's body without exposing the user's hands or arms to the expelled effluent which falls gravitationally into a receiving vessel. It is another specific object to provide a wringable sponge mop which is designed so that, if desired, a flat sponge may be employed therewith which is configured so as to permit the mopping of surfaces immediately adjacent upstanding objects without scratching or otherwise causing damage to the latter.

It is another specific object to provide a wringable sponge mop whose basic design lends itself to alternative embodiments, each of which features a single roller mechanism for rolling across the flat mopping surface of the cleaning element and expressing absorbed and entrained fluids and contaminants therefrom on both the initial roll and return roll of the roller mechanism. In short, each embodiment features a single roller which effectively provides two-way wringing with minimal lost motion.

It is still another specific object to provide a flat-faced mop design including a pivotally-mounted lever for actuating a wringer roller which in one embodiment rotates at a constant radius or limited-variable radius during the wringing-out cycle and in another embodiment is resiliently mounted to provide wringing contact with the flat face and substantially-constant wringing forces at varying radii from the pivot point of the lever.

It is still another specific object to provide a wringable sponge mop wherein the wringing mechanism in an at-rest position does not unduly obscure a surface being mopped and is compactly disposed in relation to the mop itself so as to minimize the space requirement for storage when not in use.

It is a still further specific object to provide a wringable sponge mop having a flat mopping surface which is simple in design, cost competitive to manufacture, efficient in mopping performance, easy to use and store, not messy when wringing liquids therefrom and readily understood and recognized by the purchasing public as a desirably-usable product.

These and other objects of the present invention will become apparent from the description hereinafter set forth.

It should be understood that the relationships of the mop parts described in this disclosure assume that the mop is positioned as in a typical floor mopping operation. Specifically, the mop head is in contact with the floor, the mop handle extends upwardly therefrom at a convenient angle, and the user holds the mop handle with one or both hands towards the free or upper end. Thus, for example, when something is described herein as being downward facing, such description refers to a direction towards the surface being mopped, e.g., the floor. Similarly, when a component of the mop is referred to as forward or rearward facing, it refers to directions away from or toward the mop user, and so forth. These are the relationships depicted in the accompanying drawings which are hereinafter described.

It should also be understood that the desirable attribute of a single roller unit also encompasses a single roller axis on which a series of roller sections may be mounted, essentially end-to-end. This contrasts with prior art mechanisms having a plurality of roller units with separate roller axes, each supporting a separate roller unit having one or more roller sections. The single roller unit with a plurality of roller sections is depicted in the preferred embodiment of the accompanying drawings.

SUMMARY OF THE INVENTION

In accordance with the present invention, the self-wringable mop comprises an elongated handle having a longitudinal axis and a support assembly secured adjacent the normally-lower extremity of the elongated handle. The support assembly has a generally-planar surface disposed at an angle to the longitudinal axis and provides support for the compressible absorbent cleaning element detachably secured thereto. A preferred means for fastening the cleaning element to the support assembly is disclosed as part of the detailed description hereinafter set forth.

The compressible absorbent cleaning element is typically a porous natural or synthetic sponge having a first side or surface substantially registering with and detachably secured to the generally-planar surface of the support assembly by user-friendly means hereinafter described. The opposed second side or surface of the sponge has a substantially-flat surface which is exposed and oriented so that in a typical mopping operation the full area of the substantially-flat surface is readily and conveniently contactable and registers with the surface to be mopped when employed by the average user. This relationship is preferably achieved by a combination of the angular disposition of the support element relative to the longitudinal axis of the handle and the shape of the cleaning element itself, which may have a uniform or non-uniform thickness, as will be apparent hereinafter.

A manually-actionable wringing assembly is disposed so that upon actuation it compresses and progressively wrings out the compressible absorbent cleaning element. The assembly comprises a lever mechanism which is pivotally mounted in relation to the elongated handle and has a single roller element or unit operably secured to the lever mechanism and disposed so that upon manual actuation of the lever mechanism the roller unit rolls over the substantially-flat second surface and resiliently and progressively compresses the cleaning element. Such action effectively wrings out any fluids contained therein on both the initial and return strokes of the lever mechanism, that is, without lost motion.

The single roller unit or element may be disposed at a fixed radius with respect to the lever mechanism, or in an alternative embodiment, it may be resiliently mounted for rotation at limited or fully variable radii. The resilient mounting of the roller unit, preferably by means of a heavy-duty torsion spring mechanism, accommodates cleaning elements of varying thicknesses and varying radii of the roller axis from the pivot point as the roller passes over the substantially-flat surface of the cleaning element. The resilient mounting assures a substantially constant roller force on the substantially-flat surface of the cleaning element despite variations in the thickness or compressibility thereof.

The wringing assembly is configured and disposed when in an at-rest position so as not to interfere with the normal mopping operation. In addition, the compressible absorbent cleaning element can be advantageously dimensioned so that at least a peripheral portion of the second surface or side, that is the side with a downwardly-facing, substantially-flat surface for contact with the surfaces to be mopped, extends beyond the corresponding extremity of the support assembly, and preferably the wringing assembly. The extended peripheral portion preferably includes both the front and side extremities, whereby mopping action adjacent upstanding articles, such as walls, furniture, and the like, is facilitated while inhibiting potentially-damaging or appearance-maring contact of the support assembly therewith and cushioning such contact should it occur.

In a typical embodiment, the extended peripheral portion is readily formed by severing one or more of the normally-vertical sides of the sponge element at an outward and downward angle during manufacture, whereby the substantially-flat surface of the second side of the sponge element extends beyond the corresponding surface of the first side. In short, the second side of the sponge element which contacts the surface being mopped has a greater area than the first side which is detachably secured to the support assembly.

In another embodiment, the rearward-facing surface of the sponge element may also be optionally configured to ease the roller from its at-rest position to its rolling position on the exposed downward-facing flat surface of the sponge. This embodiment facilitates the wringing cycle and reduces sponge-element stress.

In still another embodiment, ease of periodic replacement of the cleaning element and protection against damage of upstanding articles is further achieved by including as part of the first or upper side of the cleaning element a plastic mounting plate secured thereto, preferably permanently, e.g., adhesively or by other suitable means. This plate has integrally-molded upstanding edge portions overlying the edge portions of the support assembly which is typically metallic. These edge portions of the mounting plate, alone or in combination with inwardly disposed clips, provide attachment means or a part thereof for detachably securing the cleaning element to the support assembly. The upstanding edge portions also shield the metallic edge portions of the support assembly from scraping contact with upstanding articles.

As will be apparent from the detailed description of the drawings, the plastic mounting plate may also have downward-depending edge portions, preferably at the front and rear to provide additional support for the sponge and a partial rolling surface for the roller. In addition, the plastic mounting plate may have recesses or pockets for receiving sliding mounting clips on the support assembly whereby the cleaning element is detachably secured thereto.

The manually-actionable wringing assembly is rearwardly facing, that is, facing in the direction of the user of the mop. This minimizes any contact or interference with any upstanding surfaces which may be encountered when mopping in a forward direction. It also assures that the user can see all of the forward extremity of the cleaning element during the mopping operation.

In keeping with the objects of good mopping visibility and compactness of design when both used and stored, the manually-actionable wringing assembly includes means for stabilizing the lever mechanism in an at-rest position. This position is preferably adjacent to and in line with the elongated handle.

In addition, the manually-actionable wringing assembly is designed, as set forth hereinafter, so that the roller unit can effectively traverse substantially the entire exposed flat surface of the sponge by rotating the actuating lever through an arc of less than about 120°, preferably less than about 100°. This relatively-small arc avoids awkward wringing efforts and the need to change the position of the hands to achieve same. It also avoids the unsanitary and messy exposure of the user's hands and arms to the expelled mopping fluid and any contaminants contained therein. Actuation by the user simply involves pushing in an arc-like direction the lever away from, and pulling it back toward, the user in ergonomically favorable motions.

Synthetic porous sponges have been employed extensively in modern day mops of the type contemplated herein, and such mopping media may be employed in the embodiment described herein. The detailed description hereinafter set forth assumes such media to be used, but those skilled in the art will recognize that the invention is not limited thereto. Natural sponge materials and the like may also be effectively and advantageously employed.

BRIEF DESCRIPTION OF THE DRAWINGS

The present invention will be more clearly understood from the following brief descriptions of a preferred embodiment, as well as an alternative embodiment, which should be read in conjunction with the accompanying drawings, wherein:

FIG. 4 is a less-detailed partial side elevation view of the lower portion of an alternative embodiment which is very similar to that of FIGS. 1–3 except that the manually-actionable wringing assembly features a limited-variable, fixed-radius wringing mechanism.

FIG. 5 is similar to FIG. 4 except that the lever mechanism is disposed half-way through the wringing cycle, as in the embodiment shown in FIG. 2;

FIG. 6 is an enlarged fragmentary view of the embodiment of FIGS. 4 and 5 with the roller unit shown in dashed lines in several positions of the wringing cycle; and FIG. 7 is a perspective view of the light-duty spring employed in the embodiment of FIGS. 4–6.

In the detailed description hereinafter set forth, FIGS. 1–2 and 4–7 provide an overall view of the construction and operation of the wringable flat-sponge mop of the present invention. The specifics of the construction of the preferred embodiment, however, are best set forth and understandable by reference to the description of the exploded view of FIG. 3.

While some mechanical detail of the depicted embodiments have been omitted, particularly in the case of the embodiment of FIGS. 4–7, such detail is not per se part of the present invention and is considered well within the comprehension of those skilled in the mopping arts without further amplification in the light of the present disclosure. Moreover, details shown in certain views or embodiments are omitted in other views or embodiments as unnecessary and in the interest of clarity and simplicity.

It should be understood, of course, that the invention is not limited to the particular embodiments illustrated, i.e., the embodiments of FIGS. 1–3 and FIGS. 4–7.

DETAILED DESCRIPTION OF THE DRAWINGS

Figure 1:
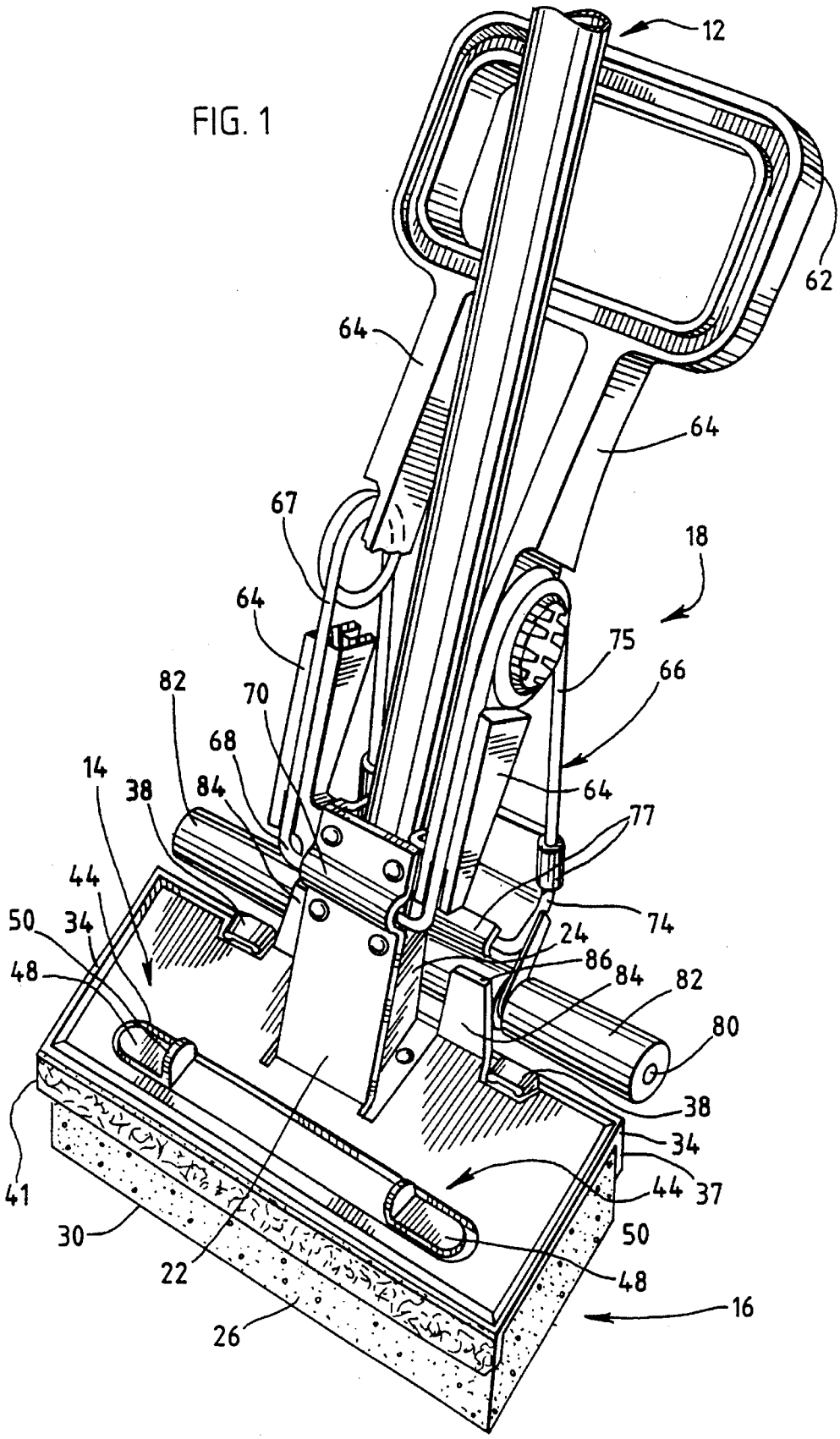
FIG. 1 is a partially-broken-away perspective view of the lower portion of preferred embodiment of the present invention featuring a manually-actionable, fully-variable-radii wringing mechanism.

Referring to FIG. 1, a self-wringing mop of the present invention comprises elongated handle 12, which may be of conventional design, including a longitudinal axis (not illustrated but otherwise manifest). Because elongated handle may be as much as four feet in length or longer, and the focus of the present invention is at the lower end, the upper portion of elongated handle 12 is not portrayed in any of the drawings but may be of conventional design. At the lower extremity of elongated handle 12 is a support assembly 14 which has generally-planar upper and lower surfaces disposed at a convenient angle to the axis of handle 12. Support assembly 14 provides the support for compressible absorbent cleaning element 16 which is detachably-secured to support 14.

The angle at which the support assembly 14 is mounted with respect to the longitudinal axis of handle 12 is chosen so that when the average user employs the mop in a convenient and comfortable disposition, the substantially flat exposed lower surface of the compressible cleaning element is fully contactable with the surfaces to be mopped. The mounting angle is selected, of course, so as to compensate for any progressive change in thickness of the compressible cleaning element in the forward-rearward direction, the objective being full and complete contact between the flat lower surface and the flat surfaces being mopped.

Manually-actionable wringing assembly 18 is disposed generally to the rear of handle 12, support 14, and cleaning element 16 when it is in the "at-rest" position, as depicted in FIG. 1. This out-of-the-way positioning of wringing assembly 18 eases mopping effort, enhances visibility for the mop user and minimizes storage space.

Figure 2:
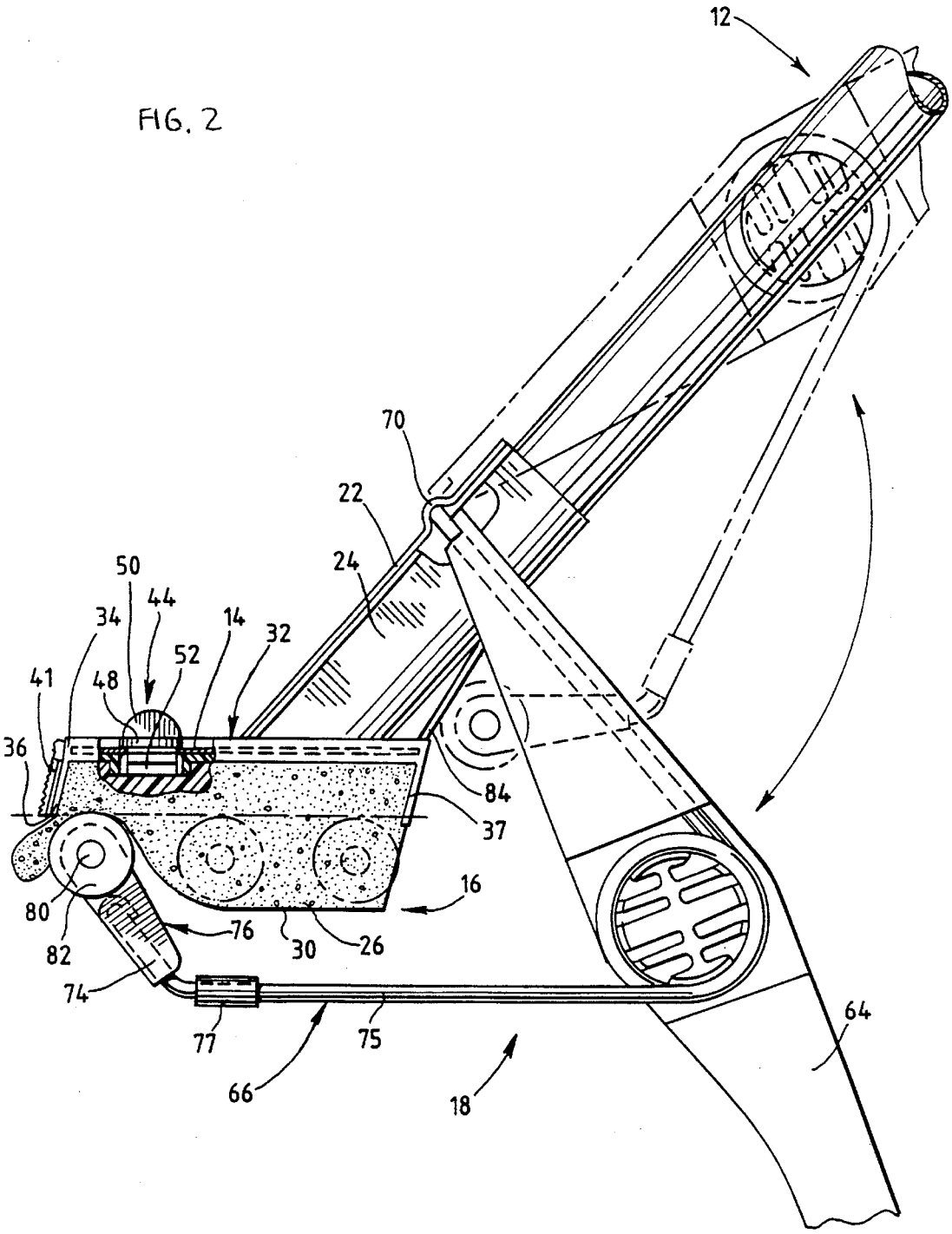
FIG. 2 is a partially-broken-away side elevation view of the embodiment of FIG. 1 showing the lever mechanism of the manually-actionable wringing assembly downwardly rotated so as to drive the roller unit forwardly to compress and wring out the absorbent cleaning element, initial and intermediate positions of the roller unit being indicated by dashed lines.

FIG. 2 portrays the wringing action by showing the wringing assembly 18 in mid-cycle as compared with the "at-rest" position, the latter being indicated in FIG. 2 by the dashed lines in the upper right portion thereof. In addition, several intermediate positions of the roller unit of wringing assembly 18 as it progressively compresses the sponge in both the forward and return strokes of the wringing cycle are also illustrated in dashed lines to indicate that despite the change in radii, the rollers can maintain for all practical purposes a substantially-constant pressure and level of compression on the sponge, as indicated by the dashed horizontal line through the sponge, as those skilled in the art will recognize.

Figure 3:
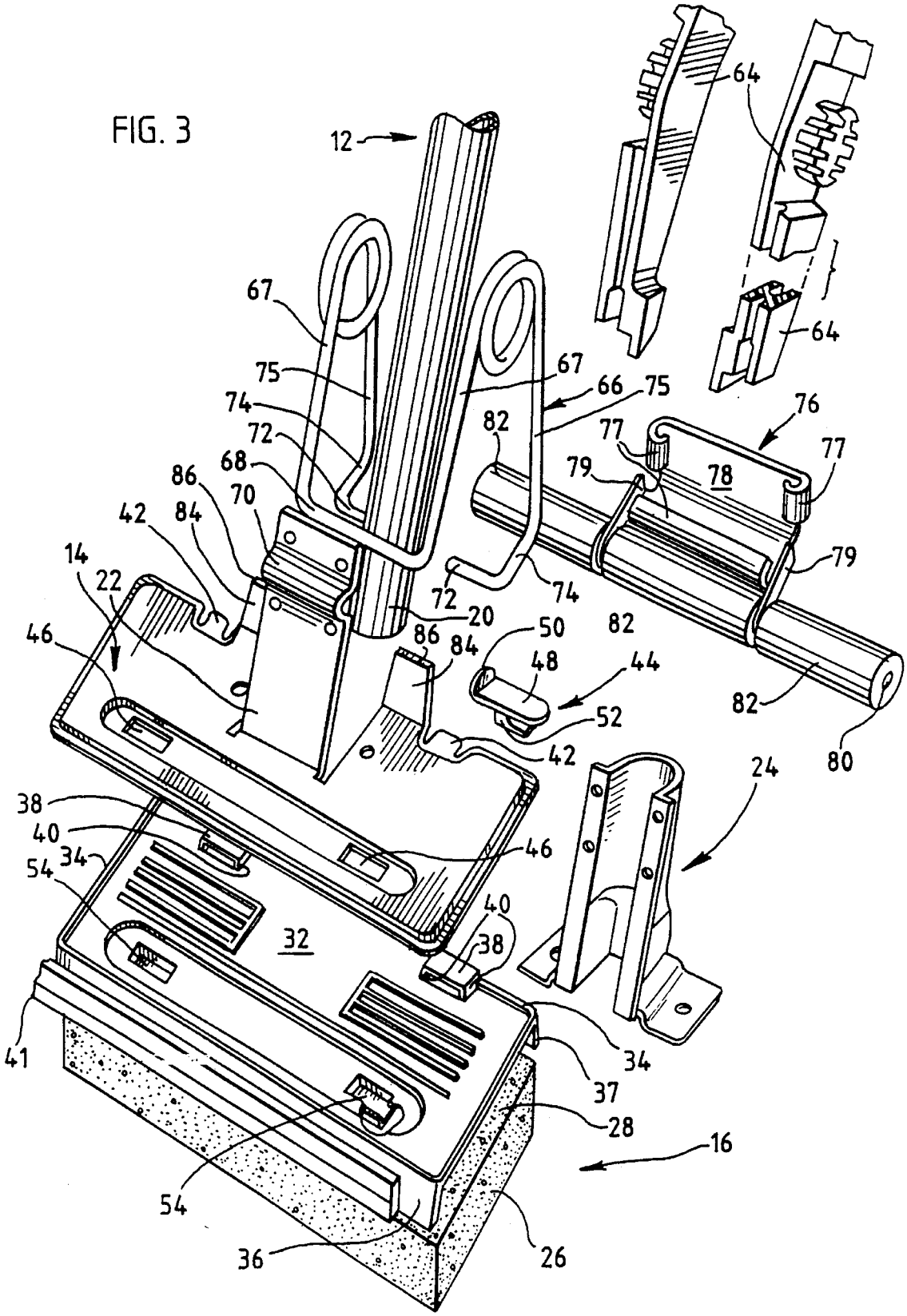
FIG. 3 is an exploded view showing the disassembled components of the embodiment of FIGS. 1 and 2.

The components making up the embodiment of FIGS. 1 and 2 are shown in detail in the disassembled exploded view of FIG. 3. It will be noted that handle 12 has a lower extremity 20 which is permanently attached to support assembly 14 by means of a gripping pocket. The latter comprises integrally-formed, forward-facing plate 22, and rearwardly-disposed semi-cylindrical complementary structure 24 which is affixed, preferably by riveting, to support assembly 14 and to plate 22 by means of rivets or other suitable fasteners through the registering apertures.

Cleaning element 16 typically comprises a natural or synthetic sponge 26 having a first or upper surface 28 which substantially registers with and is detachably-secured, directly or indirectly, to the lower surface of support assembly 14. Sponge 26 also has a second or lower substantially-flat surface 30 which is contactable with the usually-substantially-flat surface to be mopped.

In the preferred embodiment of FIGS. 1–3, support assembly 14 is metallic and has outer peripheral edge positions. To shield these edge portions from direct contact with upstanding articles in the pathway of the mop, the first or upper side of sponge 26 is secured, preferably adhesively, to an intermediate plastic mounting plate 32 having integrally-molded upstanding edge portions 34 which overlie the outer peripheral edge portions of the metallic support assembly 14. Plastic mounting plate 32 may also include downward-depending forward and rearward edge portions 36 and 37 to support sponge 26, to relieve stresses caused during the two-way wringing cycle and to provide a guide surface for the roller unit as the wringing cycle is initiated, as will hereinafter be apparent.

Plastic mounting plate 32 also includes means for detachably securing cleaning element 16 to mounting assembly 14. The means comprises upraised plastic edge plates 38 with supporting sides 40 which are integrally formed on the rear periphery of mounting plate 32 and register and interfit with dual-slotted edge portion 42 (FIG. 3) on each side of the rear of support assembly 14.

Once the rear of cleaning element 16 is engaged and thereby secured to the rear of support assembly 14, as above described, the forward portion thereof is detachably locked together by means of releasable plastic locking devices 44 slidably secured to rectangular apertures 46 on support assembly 14. Locking devices 44 comprise upper slide plate 48, upstanding finger actuator 50 and lower open jaw portion 52. Locking devices 44 are designed so that lower open jaw portions 52 fit through apertures or pockets 54 in support assembly 14 when locking devices 40 are disposed towards each other. When locking devices 44 are then slid by means of finger actuator 50 away from each other, the lower outward-facing open jaw portions 52 interlock with the respective outer side extremities of the apertures 54 in the forward portion of plastic mounting plate 32. The openings in the outerside extremities of apertures 54 are illustrated in the cutaway view of the right-hand aperture 54 of FIG. 3. The interlocked disposition of locking devices 44 is illustrated in the cut-away portion of FIG. 2.

As is thus apparent, cleaning element 16 is releasably attached to support assembly 14 by initially sliding upraised plastic plates 38 of mounting plate 32 so as to interlock supporting sides 40 with rear slotted edge portions 42 on support assembly 14. The respective forward portions of support 14 and mounting plate 32 are then locked together by aligning the slidable plastic locking devices 44 in the apertures 46 of support assembly 14 whereby lower open jaw portions 52 enter apertures 54 on plastic mounting plate 32 and then sliding them outwardly by means of finger actuators 50.

The geometry and thicknesses of the plastic material of mounting plate 32 relative to the size of the apertures is designed so that cleaning element 16 remains fastened to support assembly 14 until the release thereof is desired. The steps are then reversed, that is, slidable plastic locking devices 44 are manually forced towards each other by means of upstanding finger actuators 50, etc. Again, the geometry and thicknesses of the plastic are such that slidable plastic locking devices 44 remain secured within apertured 46 even in the inward release portion so that they do not inadvertently drop out or otherwise become loose and lost.

Manually-actionable wringing assembly 18 comprises an integrally-formed, comfortable-feeling hand grip 62 (FIG. 1) having substantially parallel lever extensions 64. These extensions are interfitted securely to relatively-powerful biasing spring 66 by means of a snap-fit feature running the length of the forward and upper portions 67 of biasing spring 66, as best shown in FIG. 1, including the cut-away portion thereof, and in FIG. 3, including the cut-away views at the upper right.

As is apparent, wringing assembly 18 is pivotally secured to the mop by means forward-facing transverse portion 68 of biasing spring 66. Transverse portion 68 is pivotally supported within semi-circular bearing 70 which is integrally formed in the upper portion of plate 22 between the rivet holes, as shown.

The rear transverse portions 72 of biasing spring 66 and the rearward and upward spring portions 74 and 75 thereof provide the resilient support for the roller unit 76 affixed thereto by deforming multiple edge portions 77 of roller support frame 78 thereabout as indicated. Forwardly-directed side portions 79 of roller support frame 78 have apertures (not shown) adjacent the forward extremities thereof through which cylindrical rod 80 is pivotally supported and held in place by a plurality of adjacent roller sections 82 mounted in end-to-end relationship thereon. Roller sections 82 are preferably resilient and may comprise rubber or plastic cylinders which are force fitted on cylindrical rod 80. Thus, roller sections 82 and cylindrical rod 80 rotate as a unit in the apertures (not shown) of supporting side portions 79.

Biasing spring 66 is designed so that substantial forces exerted thereby tend to close the gap between forward transverse portion 68 and rearward transverse portions 72; that is, the spring forces tend to minimize the radius. Thus, in the at-rest position depicted in FIG. 1, wringing assembly 18 is spring biased whereby middle roller section 82 abuts integrally-formed upstanding roller rest 84 and hand grip 62 is biased against or adjacent the rear of handle 12.

When wringing assembly 18 is rotated downwardly and forwardly in an arc-like motion as depicted in FIG. 2, roller unit 76 moves downwardly and forwardly on to sponge 26 so as to compress it and wring it out. Since such wringing action is progressive, the expelled fluids in the direction of the motion tend to flush out dirt and the like, rather than entrapping same therein.

It should be noted that the front portion or side portions or both of sponge 26 may be increased in size progressively from top to bottom whereby the lower surface 40 has a larger area than upper surface 28, as more clearly illustrated in the embodiment of FIGS. 4–7. This enhances the capability of mopping horizontal surfaces adjacent vertical surfaces, which might be scratched, or marred by contact with other mop parts. Further optional protection is provided by attaching cushioning bumper material 41 at the upper front of mounting plate 32.

Roller rests or stops 84 which are integrally formed at the rear of support assembly 14, serve two functions. They provide a rest for the roller unit 76 when in an at-rest position. In addition, the top edges 86 of stops 84 limit the arc of rotation of the wringing assembly by blocking the path of dual lever extensions 64, as depicted in FIG. 2. The limiting of such rotation is important in order to prevent, during the wringing cycle, the roller unit 76 from rolling beyond the front edge of the sponge 26 and the forward, downward-depending edge portion 36 of mounting plate 32, including cushioning bumper 41.

Referring to the limited-variable, fixed-radius wringing mechanism of the embodiment of FIGS. 4–7, the primary distinction from the fully-variable-radii wringing mechanism of FIGS. 1–3 is found in the wringing assembly 118. Accordingly, the description of the embodiment of FIGS. 4–7 is focussed thereon and other components will not be detailed and may be considered the equivalent of those of FIGS. 1–3. Thus, handle 112, support assembly 114 and cleaning element 116 are substantially the equivalents of counterparts 12, 14 and 16 in FIGS. 1–3.

In contrast to wringing assembly 18 of the embodiment of FIGS. 1–3, wringing assembly 118 comprises essentially a unitary lever 120 the upper portion of which functions as a hand grip and the lower portion of which straddles handle 112 and is pivotally attached to the front of the handle attachment structure 124, as shown. At an intermediate point of lever 120, the upper portion of roller support lever 122 is pivotally attached, albeit very limited in pivotal motion, as hereinafter set forth. The other extremity of support lever 122 rotationally supports roller unit 126, the latter being essentially the same as roller unit 76 of the embodiment of FIGS. 1–3.

To bias lever 120 in an upright at-rest position as shown in FIG. 4, an internal light-duty spiral spring 128 (FIG. 7 and cutaway portions of FIGS. 4 and 5) is mounted on internal pin 130 with the end portions thereof bearing on the respective surfaces of lever 120 and roller support lever 122 as shown. The bias of spring 128 is much less than that of spring 66 of FIGS. 1–3 but is sufficient to assure that when the lever is disposed as viewed in FIG. 4, it will remain in that position unless manually actuated.

To permit roller unit 126 to be rotated downwardly and forwardly so as to wring out the sponge of cleaning element 116 when lever 120 is actuated by the user, support lever 122 has to rotate sufficiently counterclockwise relative to lever 120 (and against the bias of spring 128) to permit roller unit 126 to pass over the bottom edge of rest stop 134. Further rotation of lever 122 relative to lever 120 is prevented thereafter by impingement of upper portion 136 of lever 122 against the adjacent inner wall of lever 120. At this point, wringing assembly 118 becomes in effect a constant-radius unit. This is shown in FIG. 6 by the arc-shaped path of roller unit 126 indicated by dashed lines as it passes over and compresses cleaning element 116.

In another fixed radius embodiment, not shown, the distance between the pivot point for lever 120 and roller unit 126 may be constant. Again, as a result, an arc-like passage of the roller unit over the sponge surface is achieved. For certain purposes, such relationship may be advantageous.

As is apparent from the above description, the present invention copes with each of the many shortcomings of prior art wringable mops and otherwise fulfills the objects of the present invention hereinabove set forth. Thus, for example, where prior art flat sponge mops require an operating arc for the wringer actuator in the range of at least about 130° or more, the design of the present invention provides full wringing capability with an arc of less than 100° in the cases of both embodiments set forth hereinabove. This minimizes the awkward positioning of the user's hands and the exposure to contact with the cleaning liquids and mopped-up contaminants.

Only a relatively-light force is required to drive the roller unit over the sponge face. Moreover, the mop automatically squeezes twice in each two-way wringing cycle, that is, both forward and reverse wringing. Because of the short stroke and relatively-light operating forces required, multiple passes over the flat surface of the cleaning element may be made very rapidly, easily and conveniently.

As is also apparent from the above description, the wringing roller is driven over at least most of the flat face of the sponge and back and expresses fluids from the sponge ahead of the direction of the roll, that is, in both directions. This results in a more-effective purging of cleaning liquid and contaminants from the sponge then can be achieved by units employing flat plate squeeze actions which tend to drive dirt into the sponge and fail to flush it therefrom.

While many prior art squeeze type flat sponge mops are limited in the size of sponge which can be employed, the resilient-mounting embodiment of the present invention permits a wide range of thicknesses. It also permits variations therein, as well as variations in compressibility, without substantial increases in the required wringing forces.

In addition, the present design permits the use of a plastic mounting plate which not only facilitates the ease of mounting but also provides an edge guard which shields the metal edges of the mop support from direct contact with upstanding objects such as furniture legs, walls, and the like. Moreover, the combination of integral edge tabs and clips on the integral mounting plate provides convenient and secure attachment of the cleaning element to the support. This contrasts with certain prior-art attachment means located on the adjacent center line.

The use of outwardly-angled front and/or side faces of the cleaning elements in certain embodiments of the present invention facilitates the effective use of the mop in corners and adjacent upstanding objects. It also complements the aforementioned edge guard for the metal edges of the mop support in preventing damage caused by scraping contact.

It is to be understood that any allowed claims based on this application are to be accorded a range of equivalents commensurate in scope with the advance made over the prior art.

Having described the invention, what is claimed is:

1. A self-wringable mop for mopping substantially-flat surfaces comprising:

(a) an elongated handle having a longitudinal axis;

(b) a support assembly for a cleaning element secured adjacent one extremity of said elongated handle, and having a generally-planar surface disposed at an angle to said longitudinal axis for supporting a cleaning element;

(c) a compressible absorbent cleaning element having (i) a first surface substantially registering with and detachably secured to said generally-planar surface of said support assembly, and (ii) a substantially-flat second surface spaced from said first surface and exposed and oriented with respect to the handle so that substantially the full area of said substantially-flat second surface is contactable with substantially-flat surfaces to be mopped, peripheral portions of said second surface extending beyond corresponding peripheral portions of said support assembly whereby said peripheral portions of said second surface facilitate mopping-action on surfaces immediately adjacent upstanding articles while inhibiting potentially-damaging contact of said support assembly therewith and cushioning such contact should it occur; and (d) a hand actuated wringing assembly comprising (i) a lever mechanism pivotally secured to said elongated handle adjacent said one extremity of said elongated handle and having a hand grip disposed relative to said longitudinal axis for limited pivotal rotation of the lever mechanism in relation to said elongated handle, and (ii) a single roller unit operably and resiliently secured by biasing means to said lever mechanism and disposed so that upon pivotal actuation of said lever mechanism by limited pivotal rotation of said hand grip the roller unit resiliently rolls over said substantially-flat second surface and resiliently and progressively compresses said cleaning element against said generally-planar surface of the support assembly, thereby progressively wringing absorbed fluids from said cleaning element, said wringing assembly being disposed relative to said elongated handle so that when in an at-rest position it does not interfere either functionally or visually with normal mopping operation;

said support assembly being metallic and said first surface of said compressible absorbent cleaning element including a plastic mounting plate secured thereto and having integrally-molded edge portions overlying edge portions of the metallic support assembly for shielding the edge portions of said support assembly from direct contact with upstanding articles when mopping surfaces immediately adjacent thereto.

2. The self-wringable mop of claim 1 wherein the operating arc of the pivotally-mounted lever mechanism required to substantially wring out said compressible absorbent cleaning element is less than about 120°.

3. The self-wringable mop of claim 1 wherein said roller unit comprises a plurality of adjacent roller sections mounted end-to-end on a single roller axis.

4. The self-wringable mop of claim 1 wherein said wringing assembly is rearwardly facing, whereby said lever mechanism may be pivoted rearwardly and downwardly by said hand grip from an at-rest position to cause said roller unit to roll forwardly over said substantially flat surface to compress said cleaning element, and whereby said lever mechanism may then be reversed to provide two-way progressive wringing.

5. The self-wringable mop of claim 1 wherein said wringing assembly includes means for stabilizing said lever mechanism in an at-rest position adjacent to and substantially in line with said elongated handle.

6. A self-wringable mop for mopping substantially-flat surfaces comprising:

(a) an elongated handle having a longitudinal axis;

(b) a support assembly for a cleaning element secured adjacent one extremity of said elongated handle, and having a generally-planar surface disposed at an angle to said longitudinal axis for supporting a cleaning element;

(c) a compressible absorbent cleaning element having a first surface, a second surface spaced therefrom and intermediate connecting surfaces, (i) said first surface substantially registering with and detachably secured to said generally-planar surface of said support assembly, and (ii) said second surface being substantially-flat and exposed and oriented with respect to the handle so that substantially the full area of said substantially-flat second surface is contactable with substantially-flat surfaces to be mopped;

said first surface including a plastic mounting plate secured thereto and having integrally molded downward-depending edge portions overlying at least portions of said intermediate connecting surfaces; and (d) a hand actuated wringing assembly comprising (i) a lever mechanism pivotally secured to said elongated handle adjacent said one extremity of said elongated handle and having a hand grip disposed relative to said longitudinal axis for limited pivotal rotation of the lever mechanism in relation to said elongated handle, and (ii) a single roller unit operably secured to said lever mechanism and disposed so that upon pivotal actuation of said lever mechanism by limited pivotal rotation of said hand grip the roller unit rolls over said substantially flat second surface and progressively compresses said cleaning element against said generally-planar surface of the support assembly, thereby progressively wringing absorbed fluids from said cleaning element, said wringing assembly being disposed relative to said elongated handle so that when in an at-rest position it does not interfere either functionally or visually with normal mopping operation.

7. The self-wringable mop of claim 6 wherein said support assembly is metallic and said plastic mounting plate has integrally-molded upstanding edge portions overlying edge portions of the metallic support assembly.

8. The self-wringable mop of claim 6 wherein said wringing assembly is rearwardly facing, whereby said lever mechanism may be pivoted rearwardly and downwardly by said hand grip from a stabilized at-rest position adjacent to said elongated handle to cause said roller unit to roll forwardly over said substantially flat surface to compress said cleaning element, and whereby said lever mechanism may then be reversed to provide two-way progressive wringing, the operating arc of the pivotally-mounted lever mechanism to substantially wring out said cleaning element being less than 120°.

9. The self-wringable mop of claim 6 wherein said roller unit comprises a plurality of adjacent roller sections mounted end-to-end on a single axis and said roller unit is operably secured to said lever mechanism on said single roller axis intermediate adjacent roller sections.

10. The self-wringable mop of claim 6 wherein said support assembly and said mounting plate include means for detachably securing said compressible absorbent cleaning element to said support assembly.

11. The self-wringable mop of claim 6 wherein said single roller unit is operably and resiliently secured by biasing means to said lever mechanism and disposed so that upon pivotal actuation of said lever mechanism by limited pivotal rotation of said hand grip the roller unit resiliently rolls over said substantially-flat second surface.

* * * * *